United States Patent [19]

Latimer et al.

[11] 4,347,029

[45] Aug. 31, 1982

[54] PIPE TRANSFER SYSTEM

[75] Inventors: John P. Latimer; Robert Donaldson, both of Newport News, Va.; Michael Cross, Everett, Wash.; Harold MacPhaiden, Mercer Island, Wash.; Loren D. Skiles, Everett, Wash.; Henry Schauer, Bothell, Wash.; Thomas J. Reynolds, Lake Stevens, Wash.

[73] Assignee: Deepsea Ventures, Inc., Gloucester Point, Va.

[21] Appl. No.: 108,123

[22] Filed: Dec. 28, 1979

[51] Int. Cl.[3] ..... E21B 19/00

[52] U.S. Cl. ..... 414/22; 175/85; 405/170

[58] Field of Search ..... 414/22, 137, 138, 140, 414/745, 747; 175/85; 405/169, 170; 104/114, 176

[56] References Cited

U.S. PATENT DOCUMENTS

| | | | |
|---|---|---|---|
| 3,143,221 | 8/1964 | Blackmon | 414/22 |
| 3,266,582 | 8/1966 | Homanick | 414/22 X |
| 3,268,095 | 8/1966 | Durbin | 414/22 |
| 3,420,318 | 1/1969 | Delacour et al. | 175/85 X |
| 3,795,326 | 3/1974 | Neilon et al. | 414/22 |
| 3,919,902 | 11/1975 | Johnson | 414/22 X |
| 4,129,221 | 12/1978 | Moller | 414/22 |

*Primary Examiner*—David A. Scherbel

*Assistant Examiner*—Edward M. Wacyra

*Attorney, Agent, or Firm*—Barry G. Magidoff

[57] ABSTRACT

This invention provides apparatus for use on, for example, an ocean mining surface vessel, for transporting lengths of pipe from a horizontal storage rack to a main dredge line hoist, which vertically supports connected lengths of pipe from the ocean surface to the ocean floor. The apparatus includes a track between the storage rack and the dredge line support system, the track being supported at one end adjacent the storage rack and at the second end adjacent the main dredge line hoist. The main dredge line hoist being preferably supported on a platform which is pivotally connected to the vessel about at least two transverse axes. The track also preferably is segmented, the segment closest to the main dredge line hoist support being pivotable about two transverse axes relative to the pipe rack on the vessel. Preferably, the two segments of track can be connected through a vertical pivot and/or a horizontal pivot or about two horizontal pivots. Carriages, riding along the track, support each end of a pipe being transported from the rack to the main hoist support. The main hoist support further comprises an elevator for raising a horizontally supported pipe to a vertical position above the dredge line so that the lower end of the pipe can be connected to the dredge line. Further, preferably, the track is longitudinally movable and the carriages are driven along the track.

28 Claims, 31 Drawing Figures

PIPE TRANSFER SYSTEM

This invention is directed to means for transferring lengths of pipe between a storage position and a vertical pipe support system, the surfaces of the storage position and the vertical pipe support system being relatively movable. The invention is especially adapted for use in the recovery of material from the ocean floor.

With the recognition that terrestrial sources for raw materials, especially ores, are being swiftly depleted, effort has been made to obtain these valuable industrial raw materials from other sources, one being especially the abyssal depths of the oceans. Such raw materials, especially metal ores, are often found in depths of between 10,000 and 18,000 feet below the surface, requiring extremely deep water dredging means. The most valuable ores found to date are known as ocean floor nodule ores, or manganese nodules. These nodules are often found as relatively small particulate forms, including fist-sized rocks or smaller pebbles, or even as grains of sand. Sometimes solid shelves of these materials are found which would have to be broken up in order to be obtained.

A great deal of engineering effort has been undertaken to date to develop mechanical means to mine such ores and to bring the ores to the surface for further processing. One system now under development for carrying ocean floor ores to the surface of the ocean comprises a dredging vehicle, operating at or near the ocean floor, and a water-lift system, wherein the ore particles are carried upwardly to the surface in a stream of water defined by a length of pipe extending from the undersea dredge vehicle to a surface vessel. This pipe system is generally part of a so-called airlift means wherein the water within the pipe is caused to flow upwardly by means of injections of air into the pipe at points below the surface.

A serious practical problem encountered in the design and operation of such a system, occurs during one of the tripping periods, i.e., when the pipe string is lowered from the surface vessel, preparatory to setting up the mining operation, or when the pipe string is brought back up on the surface vessel, at the conclusion of a mining operation. In the majority of operating situations, the pipe string is supported from the surface vessel by clamping means which are connected to the surface vessel through gimbal means having at least two axes of pivotal motion, relative to the deck surface of the vessel. The individual pipe lengths, making up the pipe string, are generally stored on a part of the vessel outside of the gimbaled portion. Accordingly, it is necessary to transfer the pipe lengths from the storage area to the gimbaled portion, and to be able to carry out such transfer under relatively unstable conditions which may be met at sea, for example, during ocean storms. It is desirable, and often necessary, that such transfer operations be manageable under relatively rough ocean conditions.

The art has attempted to meet this problem by, for example, transferring the pipe utilizing a crane, secured to the non-gimbaled portion of a surface vessel, for transferring the pipe lengths from a similarly non-gimbaled storage area to a gimbaled longitudinal pipe system for supporting the pipe string extending down to the ocean floor. This type of transfer system is disclosed, for example, in U.S. Pat. No. 3,581,506. A second pipe transfer system from storage to a gimbaled derrick system is an inclined conveyor for carrying pipe upwardly and laterally from the surface of a ship's deck to a gimbaled platform located above the deck surface.

The systems available to date, however, have not solved the problem of transferring pipe lengths between two relatively moving surfaces. The systems are either bulky and awkward to operate, or expensive and complex.

In accordance with the present invention, there is provided a relatively inexpensive and easily operated system for transferring elongated objects between two movable surfaces. More specifically, the system according to the present invention, and the individual elements of this invention within the system, provide means to move lengths of pipe between a relatively horizontal position in storage and a relatively vertical position for dredging operations. The system of this invention comprises: vertical lifting means for raising horizontally disposed pipe lengths and laterally transferring these pipe lengths in a substantially horizontal direction; longitudinally extending track means, a first end of which is adjacent the vertical lifting means and preferably located along the centerline of a floating vessel; first carriage means longitudinally movably supported on the track means and having means for supporting one end of a pipe length, and second carriage means longitudinally movably supported on the track means and designed to support the second end of a length of pipe; drive means for moving the first and second carriage means along the track; a support platform, adjacent a second end of the track, pivotally connected to the vessel about two transverse axes relative to the vessel; vertical elevator means supported on the support platform and extending upwardly therefrom; elevator carriage means supported on the elevator means and movable substantially vertically relative to the support platform; the longitudinal track means extending from the pipe storage area to the support platform; at least the portion of the track means including the second end being pivotally mounted relative to the vessel about an axis substantially parallel to the longitudinal axis of the track; and means for longitudinally extending the track from a position directly beneath the elevator means to a position longitudinally away from the elevator means.

The individual pipe lengths are preferably stored horizontally on the vessel adjacent a first end of the track. Crane means for lifting the horizontal pipes from storage and transporting them on to the track carriages include means for avoiding pendulation during transport of the pipe between storage and track carriages. The pipe holding means on the crane further are designed to carry pipe having pivoting members extending along its length.

The track means can be segmented so that only the end closest to the elevator means is pivotally mounted. Alternatively, the entire track is pivotally mounted about a longitudinal axis, parallel to the track centerline, and to one of the transverse axes about which the support platform pivots, by mounting the entire track on pivotable mounts, for example, concave semicircular supports having bearing surfaces extending beneath and around the sides of the tracks such as ball bearings or roller bearings.

The track further preferably comprises a hinge means, connecting two longitudinal sections of track so as to permit the relative pivoting of two track sections about a horizontal axis, perpendicular to the centerline of the track. This is intended to compensate for the gimbaled motion of the elevator supporting platform.

It is pointed out that the support platform is gimbaled in order to permit isolating this platform from the roll and pitch motion of the ship on the ocean surface. This is a valuable advantage during the mining dredge operations, in order to isolate the pipe string lift system from the movement of the ocean surface. Thus, the pipe string can remain vertical without being subjected to undue tension, torsional or bending loads, which might otherwise occur if the upper portion of the pipe were directly subject to the motion of the vessel.

The invention defined herein is exemplified by the embodiments described hereinbelow and depicted in the accompanying drawings. The preferred embodiments are presented herein to provide a more clear understanding of the invention and its advantages, and not to limit the scope of the invention.

Figure 21A:
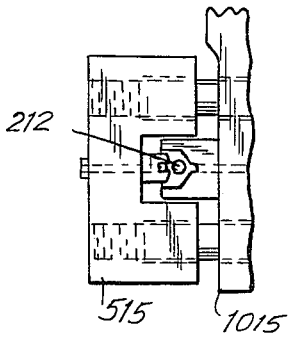
FIG. 21 is a section view along lines 21—21 of FIG. 20.
Figure 21:
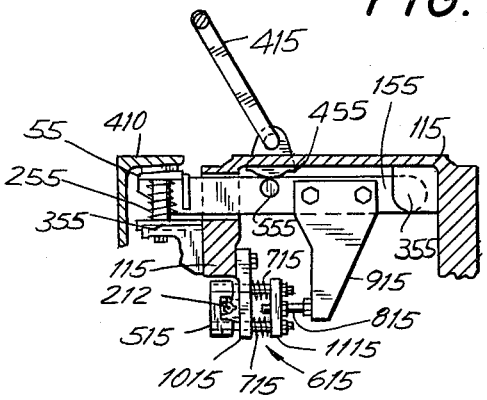
Figure 24:
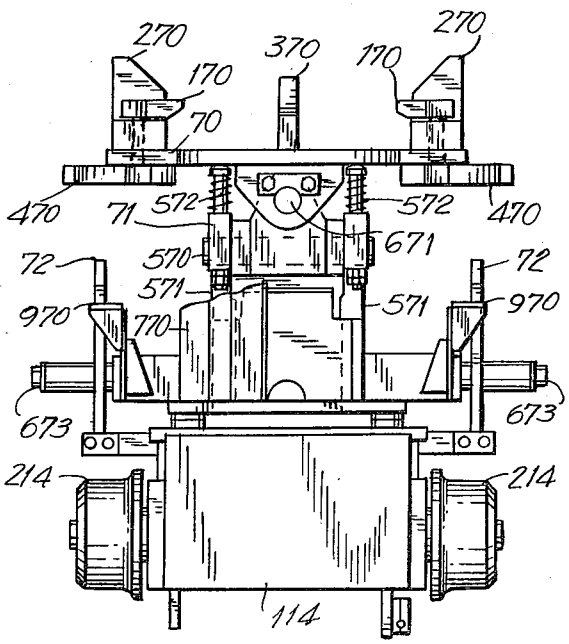
Figure 22:
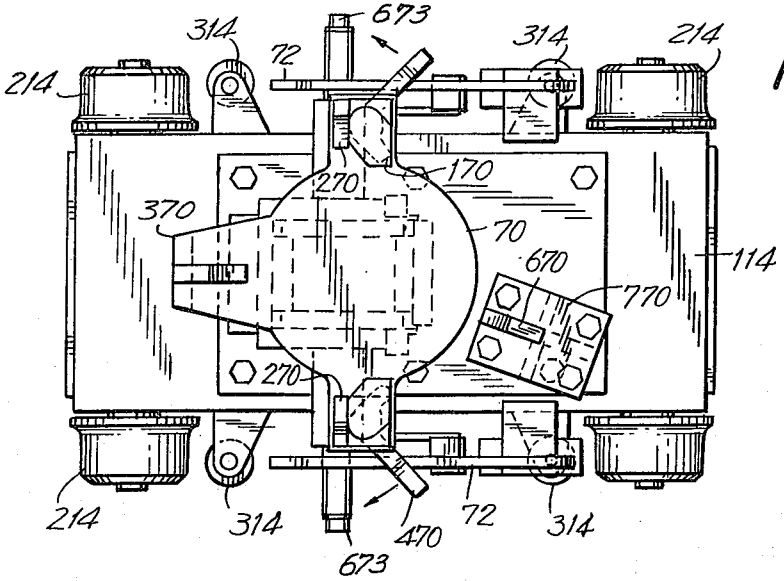
Figure 23:
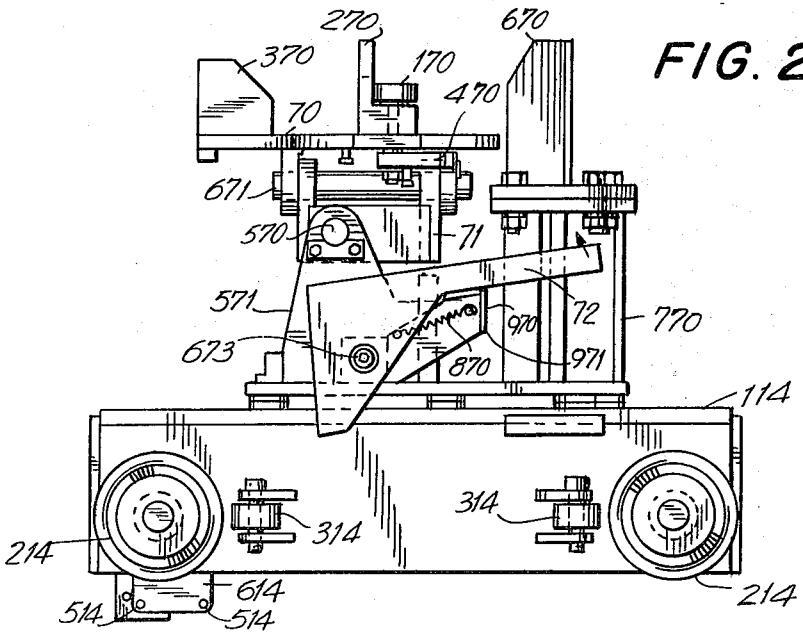
Figure 25:
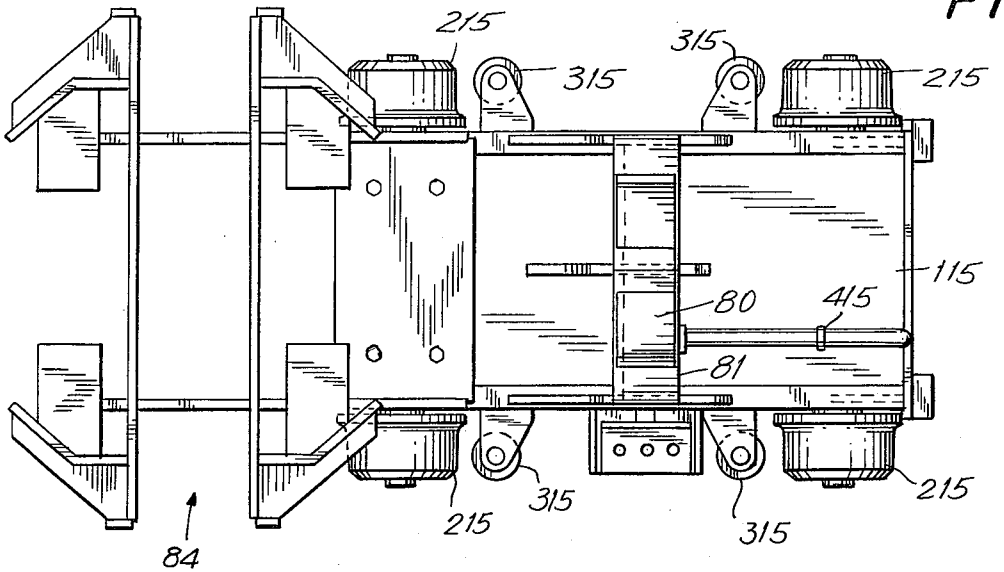
Figure 27:
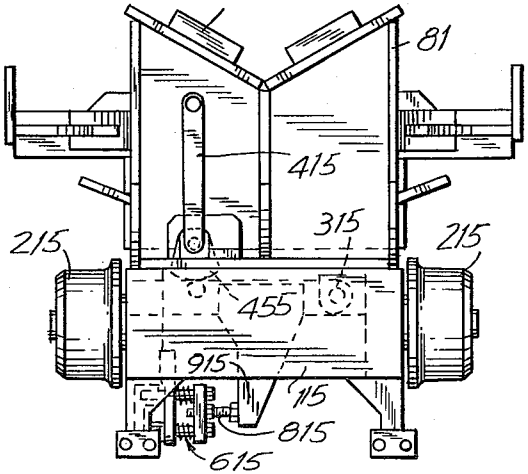
Figure 26:
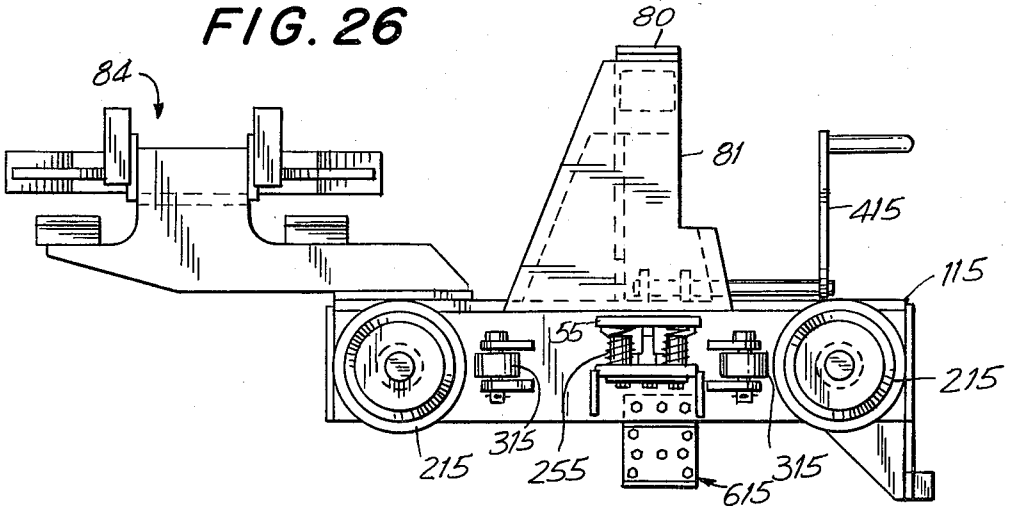
Figure 28:
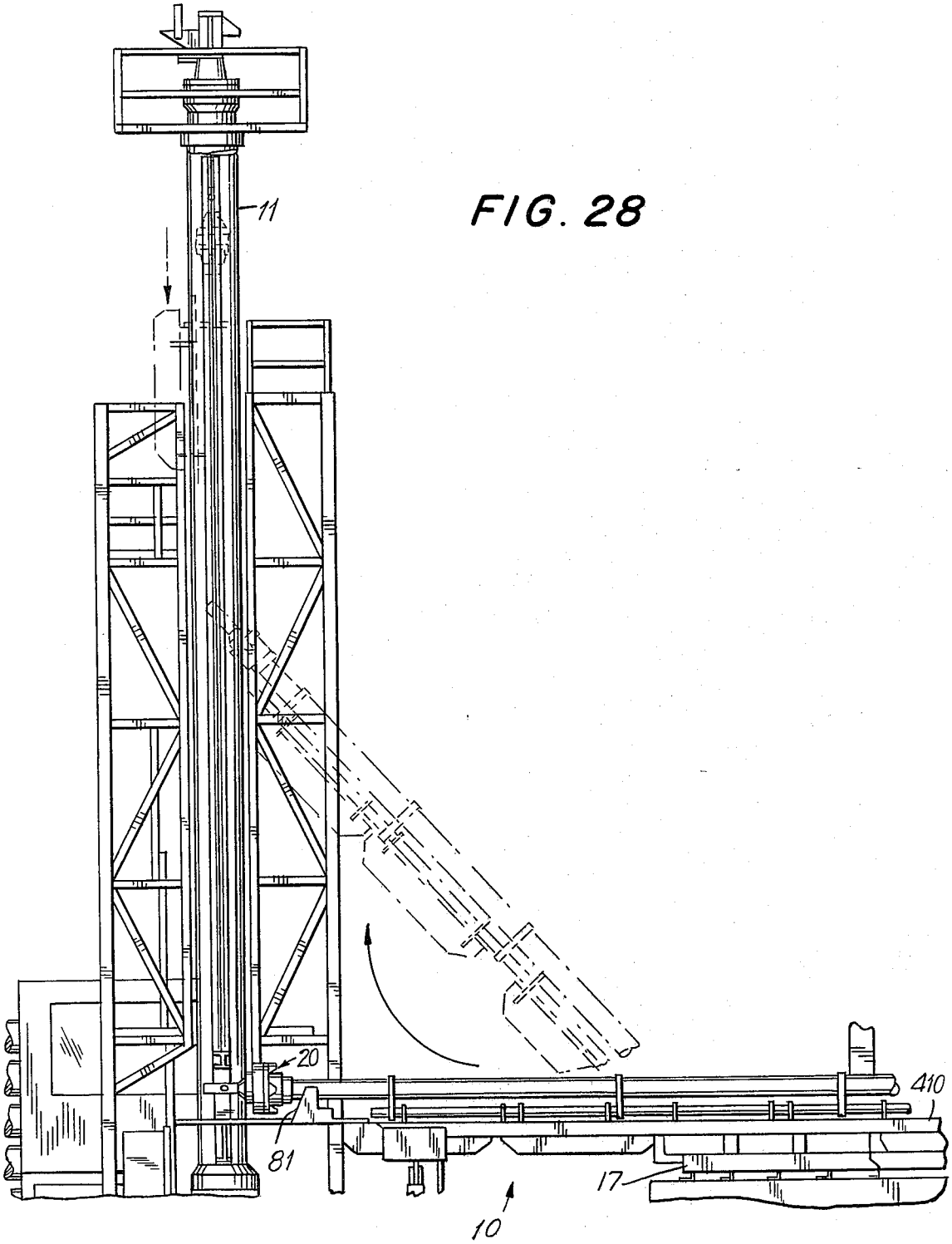
Figure 29:
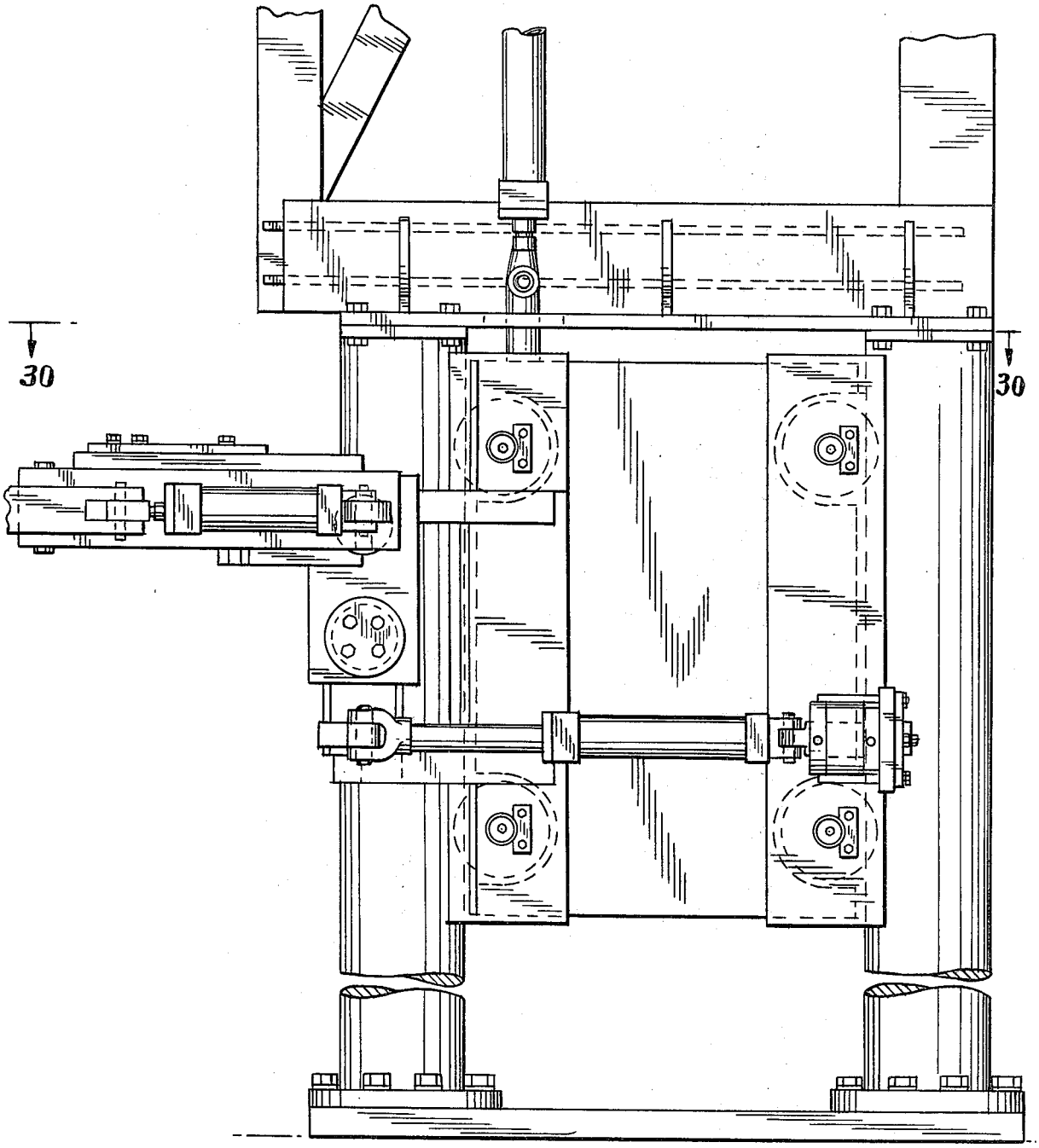
Figure 30:
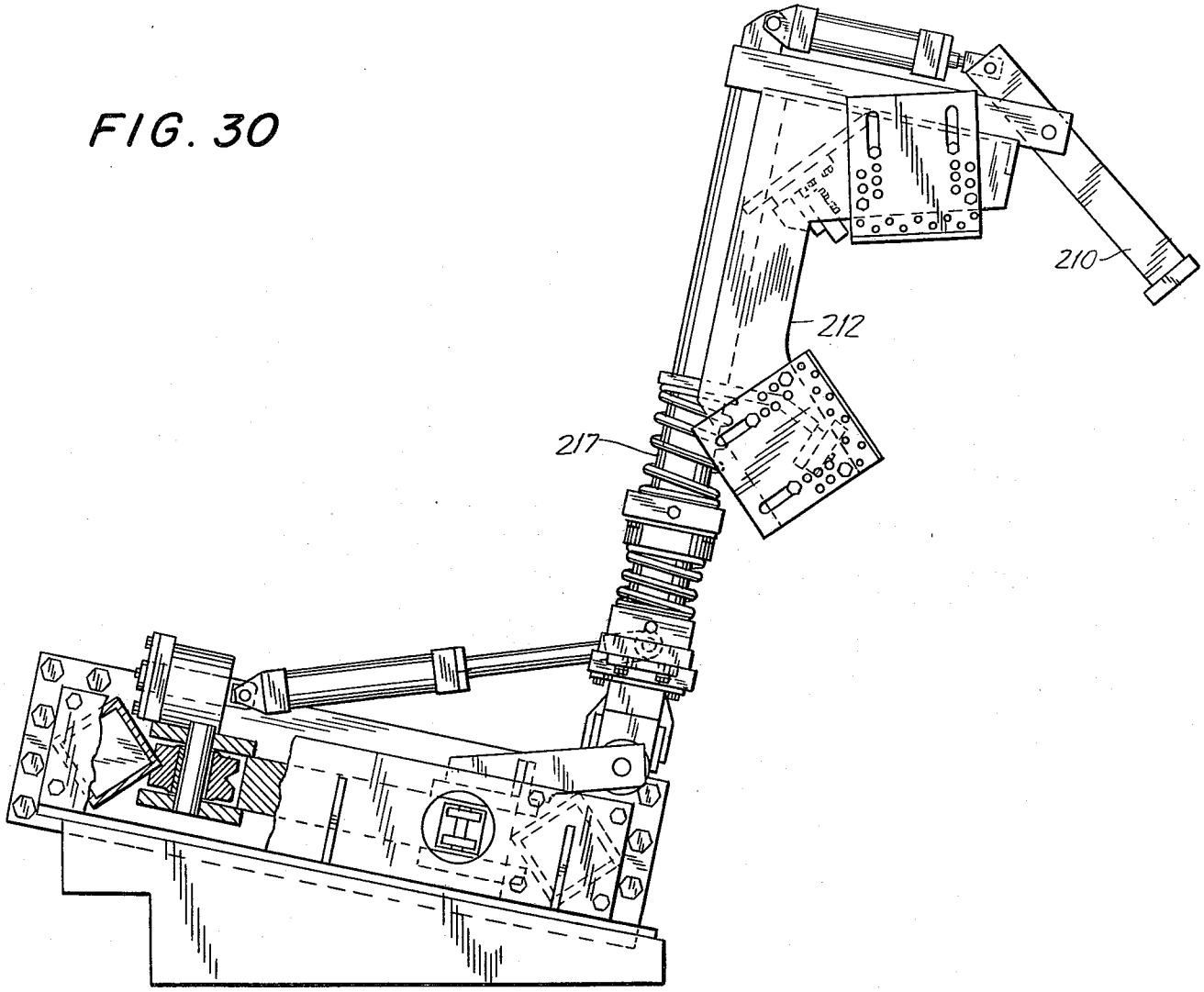

FIG. 21*a* is an enlarged view of a portion of FIG. 21;

FIG. 22 is a plan view of the heel carriage;

FIG. 23 is a side elevation view of the heel carriage;

FIG. 24 is a rear elevation view of the heel carriage;

FIG. 25 is a top plan view of the toe carriage;

FIG. 26 is a side elevation view of the toe carriage;

FIG. 27 is a rear elevation view of the toe carriage;

FIG. 28 is a diagrammatic view showing the operation of the elevator means and carriage means to hoist pipe into position;

FIG. 29 is a rear elevation view of the lower portion of the pipe support structure adjacent the gimbal; and FIG. 30 is a partial section view along lines 30—30 of FIG. 29.

GENERAL DESCRIPTION

Figure 1:
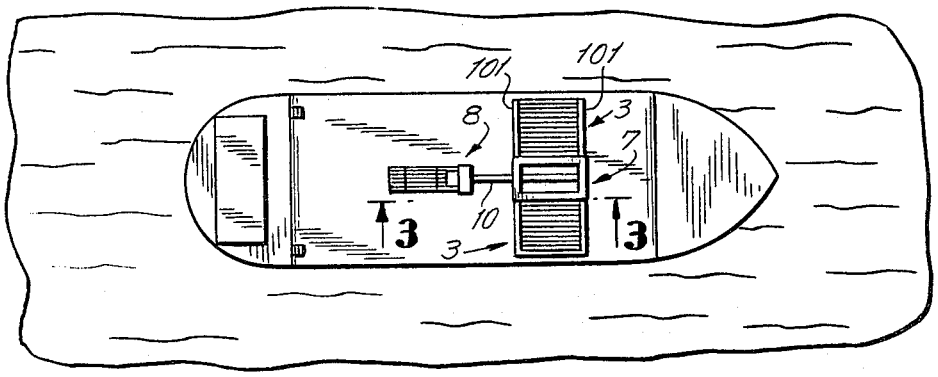
FIG. 1 is a diagrammatic plan view of an ocean-going vessel fitted for ocean floor mining operations.
Figure 2:
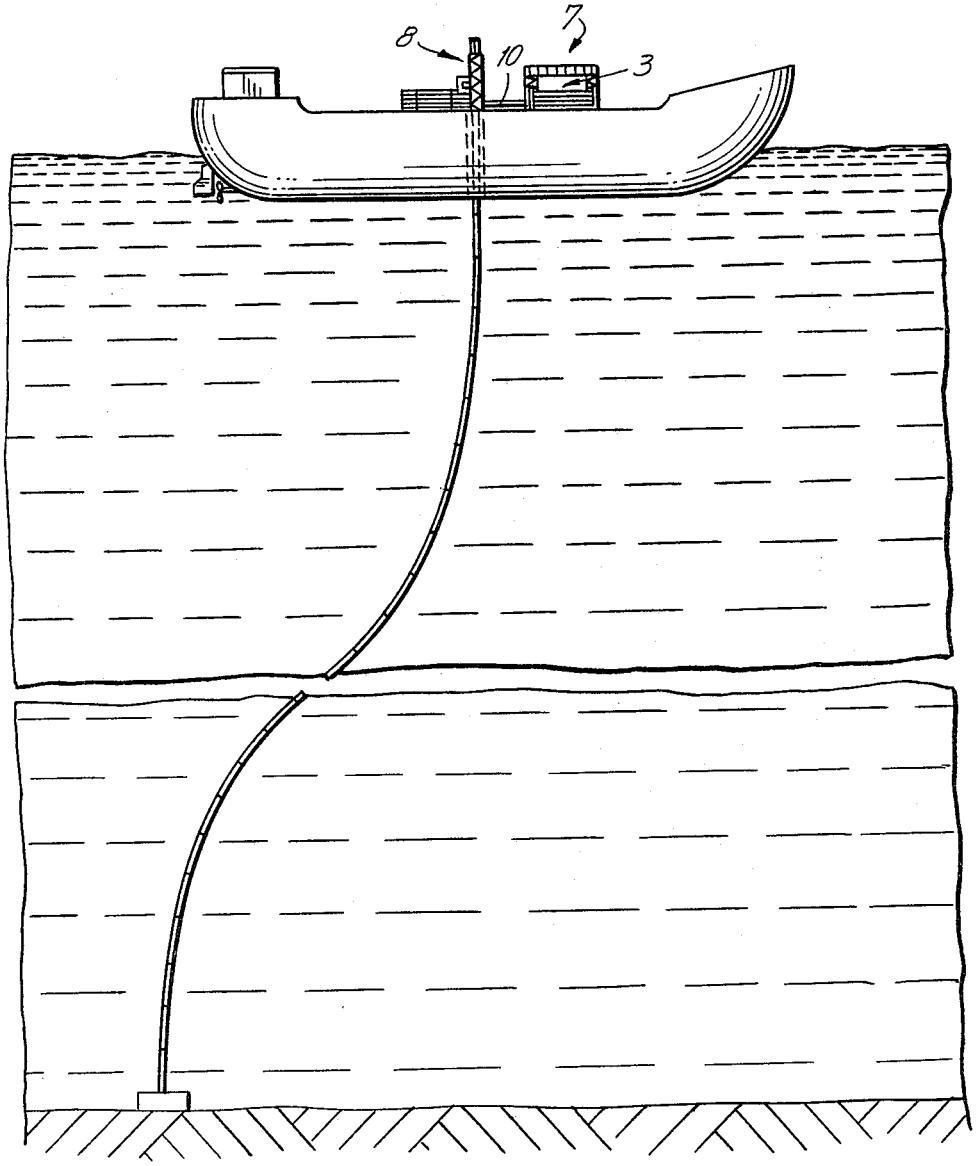
FIG. 2 is a side elevation view of the vessel of FIG. 1, including a downwardly extending pipe string extending towards the ocean floor.

FIGS. 1 and 2 show a plan and side elevational view of an ocean-going vessel designed specifically for use in ocean floor mining operations. Unusual features on this vessel, distinguishing it clearly from ordinary ocean going vessels, are shown in the drawings. These special features include a large central opening, or well, extending from the deck of the vessel through the bottom of the vessel. The well is fully enclosed, having interior wall surfaces maintaining the integrity of the vessel's hull covering. Extending above the well opening is a superstructure which can be generally called a derrick, its location being generally indicated by the numeral 8. The derrick 8 and associated pipe handling system are mounted upon a platform which is pivotable relative to the vessel about two horizontal, transverse (substantially perpendicular) axes. The derrick 8, including its associated systems, rest upon an inner gimbaled platform 33, which is pivotally supported by a gimbal axis 34 to an outer gimbal ring 32, which is in turn pivotally supported on an outer gimbal axis 31, pivotally supported on the surface vessel. Thus, the derrick 8 is pivotally connected to the surface vessel about two transverse, i.e., perpendicular, axes, which compensate for the pitch and roll of a vessel under even the extreme conditions often met with on the ocean, thereby permitting the derrick 8 to remain substantially continuously vertical regardless of the pitching and rolling motion of the vessel.

Forward of the derrick 8 is located a pipe storage rack, indicated by the numeral 3, for the storage of individual lengths of dredge line pipe. Located above and capable of moving laterally across the pipe storage rack 3 is an overhead bridge crane, generally indicated by the numeral 7, capable of gripping and transporting, both vertically and laterally, individual lengths of dredge pipe.

A longitudinal track 10, extends from a first end, adjacent the derrick 8, to a second end extending under the port side portion of the bridge crane structure 7.

Figure 3:
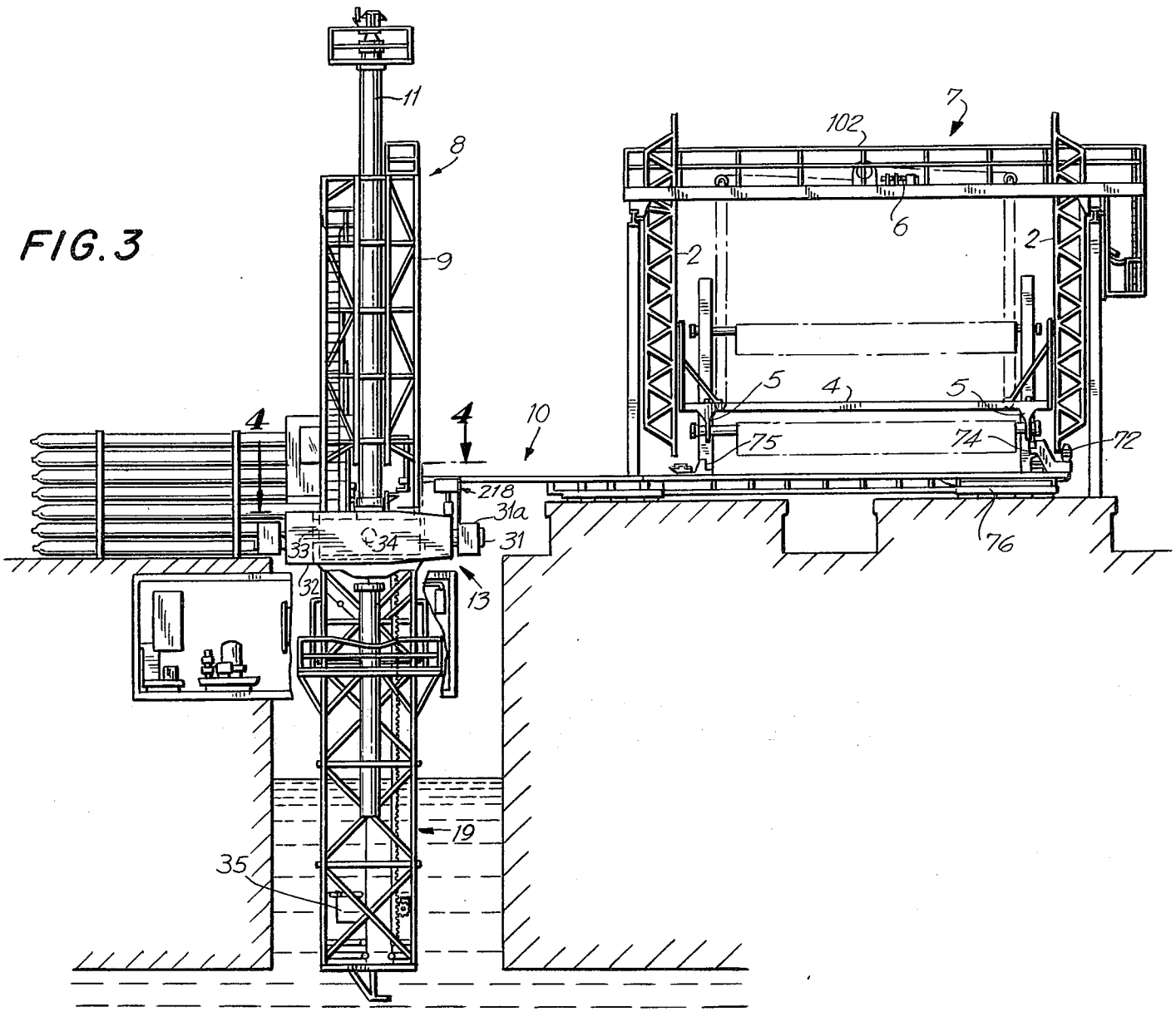
FIG. 3 is a side elevation view of the portion of the vessel of FIGS. 1 and 2 comprising the pipe storage and primary ocean floor dredging apparatus.
Figure 4:
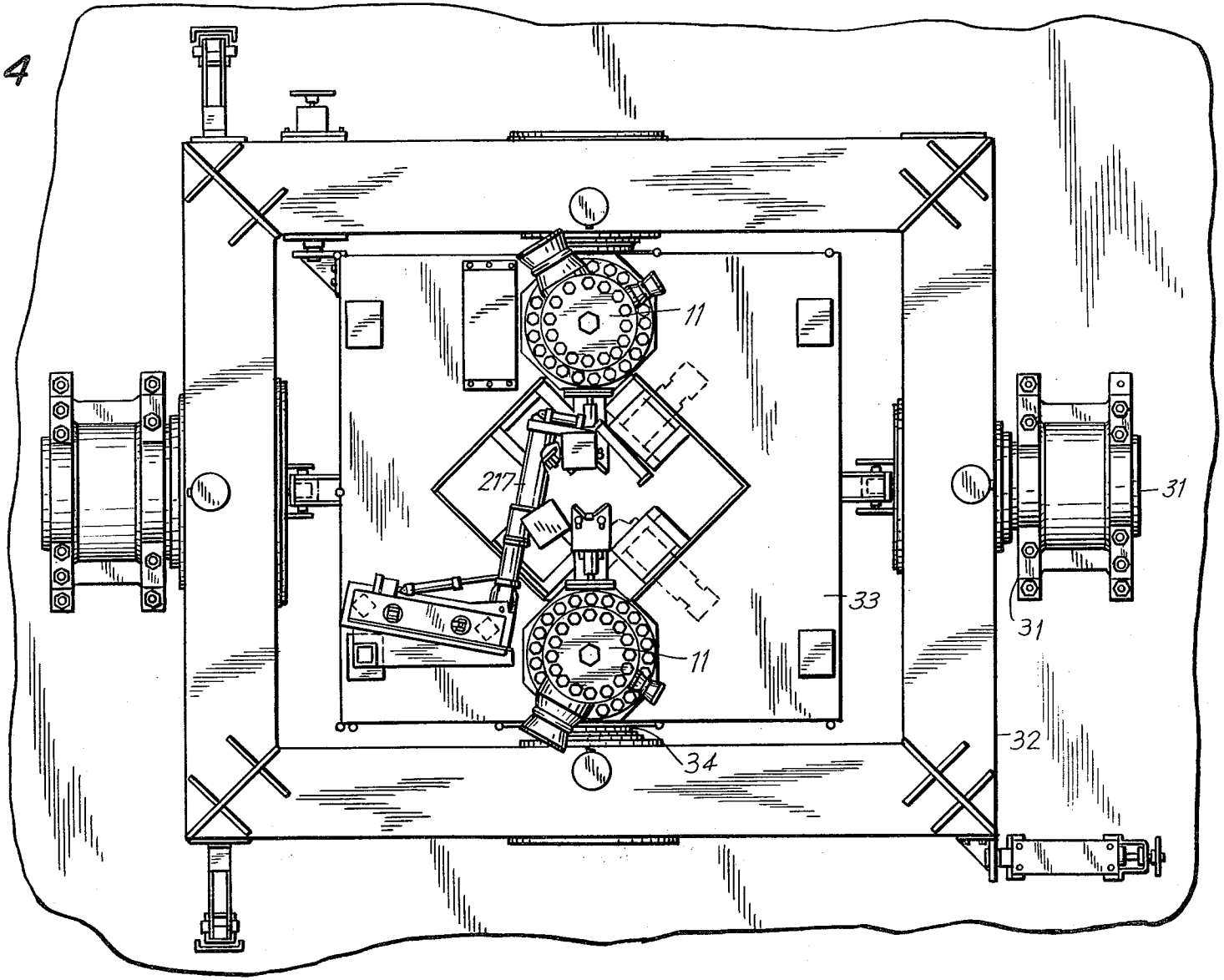
FIG. 4 is a cross-sectional view taken along lines 4—4 of FIG. 3.

As is shown very generally in FIGS. 1 and 3, the pipe storage rack 3 is situated on the deck of the ocean going vessel, forward of the center of the starboard side of the vessel. The rack 3 is so designed as to support the individual lengths of pipe from their end portions, in vertical columns and horizontal rows. As is also generally shown, for example, in FIG. 27, the rack is preferably designed so as to be able to support pipe having pivotable plates extending radially outwardly from one portion of the pipe circumference. These plates are splitter plates, and are more specifically defined in copending application Ser. No. 910,424, filed May 30, 1978. Alternatively, the pipe and the secondary pipe shown in FIG. 28 can be surrounded by an even more bulky fairing, which will also extend downwardly from the pipe. Accordingly, the rack must be designed to provide the necessary space for any such pendular attachments.

Similarly, the bridge crane must be so designed so as to be able to grip and carry the pipe without interference from these pendular attachments. As shown, the ends of the pipe are generally free from such obstructions; therefore, the bridge crane is so designed as to grip the pipe adjacent the ends thereof, beyond the area obstructed by the plates or fairing. The bridge crane 7, is generally of conventional design, providing laterally extending horizontal tracks 101, along which is moved, by a motor not shown, a crane carriage, generally indicated by the number 7, which comprises vertical truss members 2, having tracks formed on their inside facing edges, horizontal cross members 102 upon which is supported a crane motor 6. A spreader bar 4 extends between and rides vertically along the vertical truss members 2. Supported from the spreader bar 4, at either end thereof, are crane grippers 5 for holding the ends of the individual pipe lengths.

Extending from beneath the port side of the lateral horizontal crane tracks 101 to the derrick 8 is a longitudinal carriage track, generally indicated by the numeral 10, extending substantially along the central plane of the surface vessel, i.e., the central plane substantially cuts the vessel longitudinally in half, and includes the centerline of the vessel about which the vessel rolls. The carriage track 10 is movably supported above the deck of the vessel by a forward track support 16, a central support 17, and a rear pivotal track support 18. The pair of rails 410 are supported above the level of the ship's deck an amount sufficient to prevent contact between any splitter plate or fairing connected to and hanging downwardly from, a pipe supported on the track, and the deck. A portion of the length of the rails 410 is directly supported on the upper ends of posts 110, which are, in turn, connected at their lower ends to track frame members 310, 510, which in turn are supported upon rollers 311 and 511 which roll within and along the track supports 16, 17, respectively. The rear end of the track 10 is supported directly upon the rear support 18.

The track 10 is divided into two portions, the rear portion and the forward portion, being hingedly and pivotally connected at the hinge joint 40 so as to permit relative pivotal motions about at least two transverse axes between the forward portion of the rails 410*a* and the rearward portion of the rails 410*b*, i.e., a horizontal, lateral axis centered in hinge pin 240, a vertical axis centered in swiveling pin 140, and optionally a horizontal, longitudinal axis where pin 140 is a ball joint, or rotated to extend along longitudinal axis of track 10.

Figure 12:
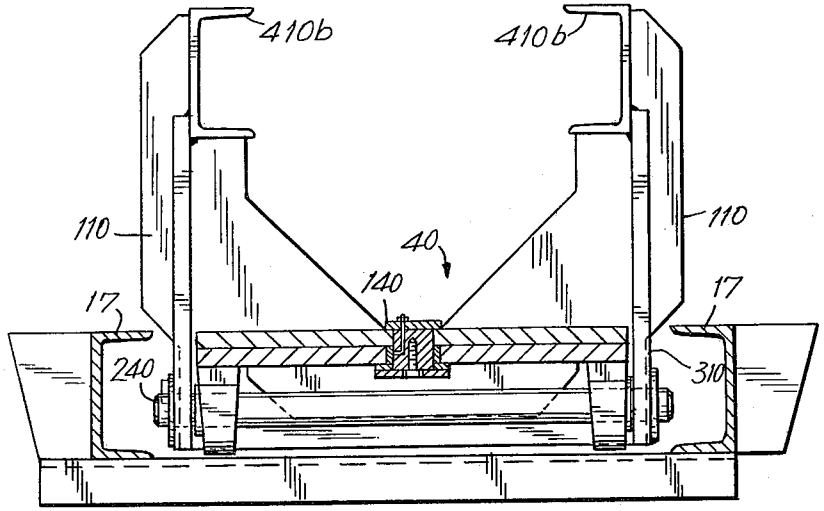
FIG. 12 is a section view taken along lines 12—12 of FIG. 10.
Figure 14:
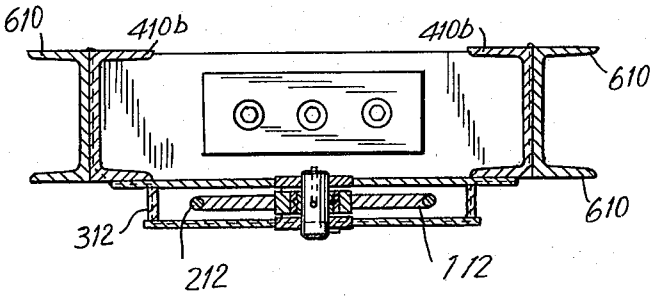
FIG. 14 is a section view along lines 14—14 of FIG. 11.
Figure 15:
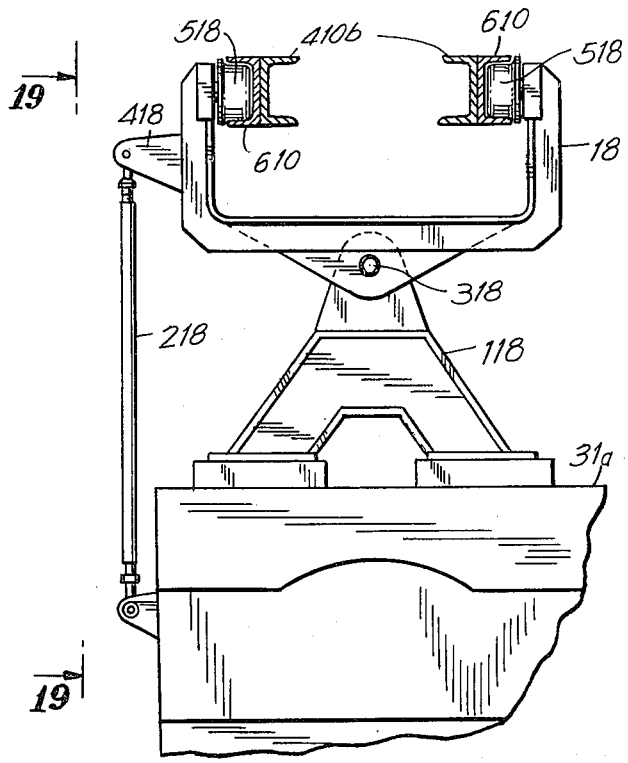
FIG. 15 is a partial cross-section along lines 15—15 of FIG. 10.
Figure 17:
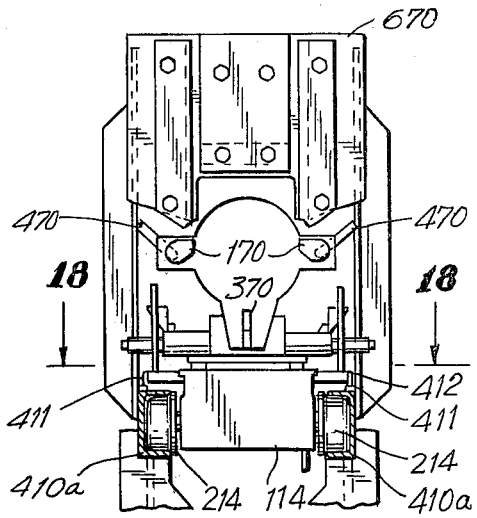
FIG. 17 is a partial section view along lines 17—17 of FIG. 16.
Figure 18:
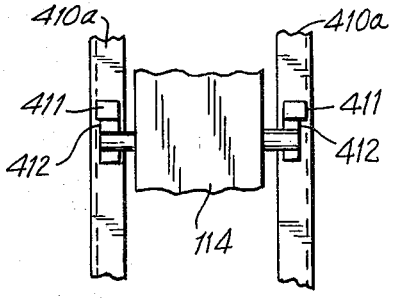
FIG. 18 is a section view along lines 18—18 of FIG. 17.
Figure 19:
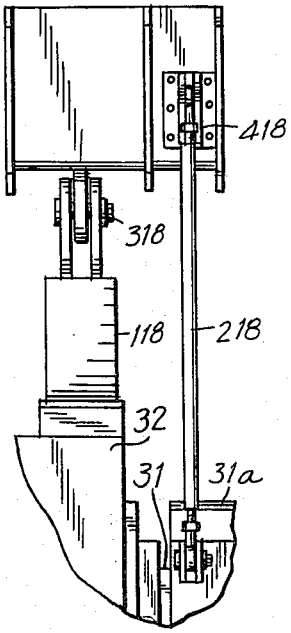
FIG. 19 is an elevation view along lines 19—19 of FIG. 15.

A hydraulic track drive, generally indicated by the numeral 111, comprising a hydraulic cylinder 121 secured to the forward track support 16, on the starboard side, and a hydraulic piston and piston rod 221, slidably held within the hydraulic cylinder 121 and pivotally connected at its outer rearward end to a track bracket 210, which is in turn rigidly secured to a track post 110. Each of the rails 410, as shown in FIG. 12, is a channel member, wherein the legs of the U, forming the channel, face inwardly towards the track's centerline. The track posts 110 rigidly connect the two rails 410, to the track frames 310, 510 and rollers 311, 511.

Extending along the outer face of the rearwardmost portions of the rails 410*b* is a second pair of channels 610, attached to the rails 410*b*, beginning rearwardly of the central track support 17. Rotatably secured to the rear track support 18 are a pair of track support rollers 518; the rollers 518 fit within and rotatably support the rear track channels 610.

The rearward track support 18 is pivotally connected to support stand 118, about pin 318. The support 118, in turn, is rigidly secured to the outer gimbal ring 32, and thus is pivotally connected to the vessel via axis 31. Track support 18 is also secured via support lever arm 218 to the gimbal axis pedestal 31*a*, which in turn is rigidly secured to the ship's deck. The length of the lever arm 218 can be adjusted by slide 418 and locked by conventional means. If the entire track 10 is pivotably connected, there is no need for the intermediate pivot joint 40.

Movably supported by the pipe track 10 are a toe carriage, generally indicated by the numeral 15, and a heel carriage, generally indicated by the numeral 14. The carriages are intended to support the two ends of an individual length of pipe. The heel carriage 14 comprises a heel carriage chassis 114, which is rotatably supported upon four carriage wheels 214, which in turn are rotatably supported within the channels of rails 410. A pair of heel carriage rollers 314 are rotatably secured on either side of the chassis 114, between each pair of wheels 214, and rotate about a vertical axis, serving to center the carriage within and between the rails 410.

Rigidly secured to the chassis 114 are a pair of pivot supports 571, pivotally supporting lateral pin 570 therebetween, perpendicular to the rails 410. The pin is in turn pivotally connected to a support base 71. The pipe support base 71 is pivotally connected to a pipe support plate 70 about longitudinal pin 671, and is biased to prevent pivoting about the pin 671 by spring-biased, slidable rods 572.

Rigidly supported in turn upon support plate 70 is a fixed lower pipe support guide 370, extending vertically upwardly from the protruding portion of the support plate 70 and two fixed lateral pipe support guides 270, extending upwardly from each side of the support plate 70, slightly to the far side of lateral pin 570 from the lower guide 370. A pipe hub locking lug 170 is pivotally connected adjacent each of the side support guides 270, and each pivots together with a pipe locking arm 470. A pipe locking lever 72 is pivotally connected to either side of the supports 571, and is rotatable from a position out of contact with the locking levers 470 to a position in contact and capable of moving the locking levers 470 to place the locking lugs 170 out of the locking position shown in FIG. 24. Each lever 72 is biased into the out-of-contact position, shown in FIG. 23, by a coil spring 870 connected between the lever 72 and the stop member 970 and rotates about member 673.

A pipe guide support holder 770 is rigidly secured to the heel carriage chassis 114, and releasably slidably holds an outer pipe support guide 670. The various pipe guides in combination are sized for a specific diameter pipe and are preferably all replaced when the diameter of the pipe being carried is changed. The entire pipe guide unit on the heel carriage, including the locking levers, are preferably changed together.

A heel stop 411 is secured to the end of each rail 410*a* and so positioned to contact heel bumper 412, on each side of the heel carriage 114, to prevent further forward motion.

The toe carriage, generally indicated by the numeral 15, also rides along the tracks 10 in a position to the rear of the heel carriage 14. The toe carriage comprises a toe carriage chassis 115, pivotally supported upon four toe carriage wheels 215, which in turn ride within the channels of the tracks 10. Side rollers 315 are also pivotally supported on the chassis 115, but about vertical axes and ride along the inner surface of the channels of tracks 10 so as to serve to center the toe carriage between the tracks. A pipe toe support stand 81 is rigidly secured at the approximate longitudinal center of the toe carriage 115 and supports thereon a pipe toe support 80 centered laterally so as to support the toe end of a horizontally resting pipe length. At the rearmost end of the toe carriage 115 there is supported a tray 84, which can be used for carrying miscellaneous items, including parts of a pipe clamp for making up the pipe joint as explained below.

Figure 20:
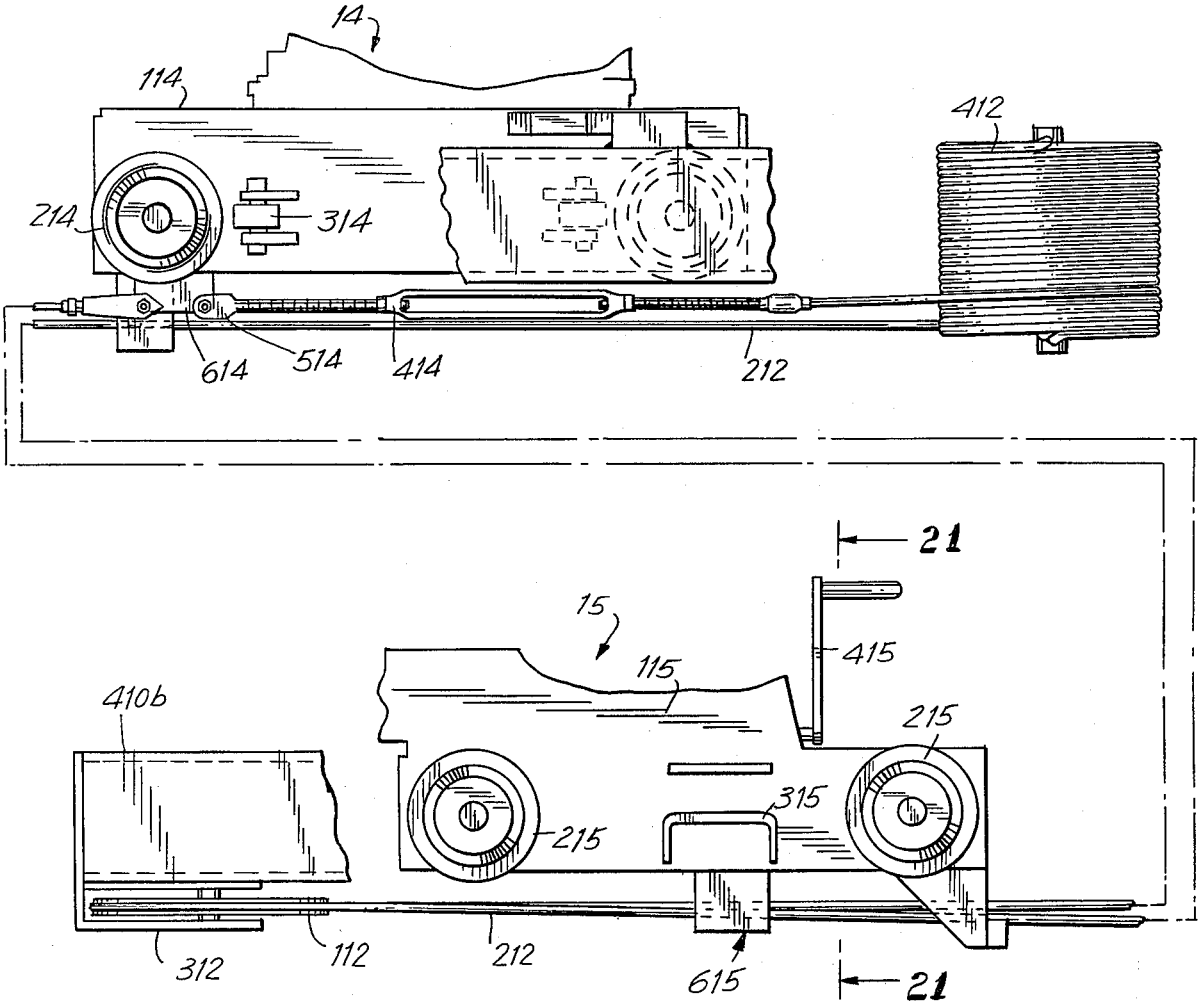
FIG. 20 is a broken and enlarged view showing the pipe carriage means and drive means for same with the track broken away.

The toe carriage and the heel carriage can both be driven along the tracks 10 by connection to a drive cable 212, as shown in FIG. 20. The heel carriage 14 is permanently secured to the drive cable 212 by cable bolts 514 which are in turn secured to the cable plate 614. The cable is secured via a cable tightener bolt 414. The cable 212 is secured about cable drive drum 612 at one end of the track, and extends along, between and below the rails 410 to a cable sheave 112, supported within a sheave shield 312, beneath the rearward end of the track 10. The cable drum 612 can be turned in either direction by an electric or hydraulic motor 512.

The toe carriage is releasably secured to the drive cable 212 by way of a cable clutch mechanism generally indicated by the numeral 615. The clutch mechanism 615 is supported by clutch support plate 1015, which is rigidly secured to the toe carriage chassis 115. The arms of a generally U-shaped clutch connector member 515, are slidably held through openings in the support plate 1015. The ends of the arms of the clutch connector 515 are secured together and thus locked onto the support plate 1015 by a connecting plate 1115. A pair of biasing springs 715 are held in compression between the support plate 1015, and the connecting plate 1115, and bias the closed end of the U-shaped connector 515 towards the support plate 1015; the drive cable 212 passes between U-member end 515 and the support plate 1015.

The connector 1115 is threadedly secured in turn to a bolt 815, the head of which is in contact with a clutch contact arm 915. The clutch contact arm 915 is rigidly secured to a central portion of a clutch/brake lever arm 155, which is pivotally connected at one end to the toe carriage chassis 115 about pin 355. The free end of the lever 155 is biased upwardly by the coil spring 255, which is supported at its lower end by a ledge 355, rigidly secured to the toe chassis 115. Secured to, and facing upwardly from, the free end of lever 155 is a brake pad 55. The pad is so positioned, as to be directly beneath the upper arm of the rail channel 410. Secured to the lever 155, intermediate the free end and the contact arm 915, is a cam pin 555.

A cam 455 is rotatably secured to the toe chassis 115, and the cam surface is in contact with the cam pin 555. The cam surface 455 rotates together with lever arm 415, in contact with the cam pin 555.

The second, or rearward, end of the track 10 rests adjacent the derrick 8. The derrick comprises a pair of main hoist cylinders 11, supported on the axis of rotation of the inner gimbaled platform 33. The main hoist cylinders 11 form the primary support structure for the derrick 8, supporting an elevator generally indicated by the numeral 20. The elevator comprises a chassis 26 guided along between two track members 22, extending vertically along the circumferential surfaces of the cylinders 11, and in a facing relationship towards each other. The elevator 20 is in turn supported by an elevator cable 23, extending downwardly from an elevator drive motor 120 suspended on a girder rigidly secured to the upper portions of the main hoist cylinders 11. The elevator 20 has two pairs of rotatable wheels 25, two moving upon each track 22, connected to the elevator chassis 26. An elevator pipe holder 24 is pivotally connected to the elevator chassis 26 and can pivot, about a horizontal axis extending between the two pairs of wheels 25, between a vertical position, facing downwardly, and a horizontal position, facing forwardly of the ocean vessel. The centerline of the elevator 20 is on the centerline of the vessel and of the carriage track 10.

The elevator pipe holder 24 pivots about a pin 23 secured to the elevator chassis 26. The pipe holder is rotated manually by pressing down upon the pipe holder handle 427, rigidly secured to the pipe holder 24. The pipe holder 24 can be locked into the horizontal position when rotated about pipe holder swing pin 23 by, for example, a common pawl-and-rachet mechanism 127. The pipe holder 24 can also be rotated about a longitudinal pivot pin 28, about an axis perpendicular to the axis of swing, and passing through the center of the pipe holder 24. The pipe holder 24 further comprises pipe clamp members 124, pivotally secured within the pipe holder body 24, all of the pipe clamp members being movable into and out of a pipe locking position by the spring-biased clamp handle 224. As shown in the drawings, the pipe to be held has an enlarged end portion, or hub, which fits within the pipe holder 24 when the clamp members 124 are swung into an unlocked position, i.e., facing along or tangent to the circumference of the pipe clamp 24; the pipe is locked in place upon pivoting the clamp members 124 so as to face in a substantially radial direction passing underneath or around the enlarged pipe hub.

A mechanical pipe holder is shown in FIGS. 29 and 30, for holding the lower free end of a pipe, suspended from the elevator 20, prior to connecting into a pipe string. This prevents swinging movement of the free pipe end during unusually rough weather, as the vessel rolls and pitches.

Operation of the pipe handling system described above and shown in the accompanying drawings, and of the individual components thereof, is described below in the context of the transfer of one length of pipe from a pipe rack to the derrick, the last several steps of which are diagrammatically shown in FIG. 28.

OPERATION OF THE SYSTEM

Figure 16:
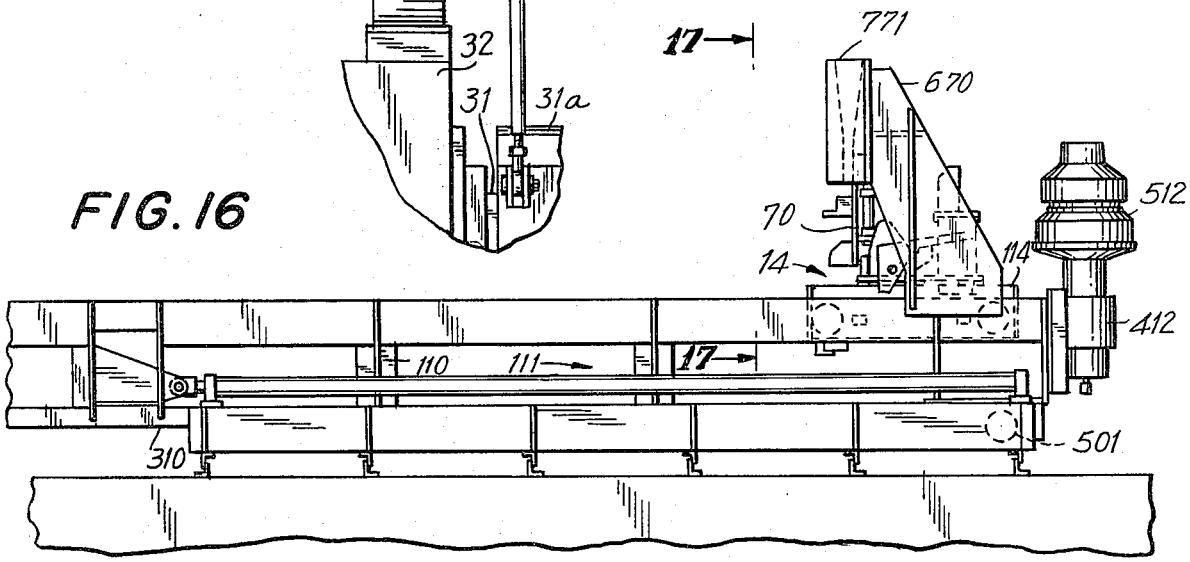
FIG. 16 is a enlarged partial view of the right hand portion of FIG. 11 including a carriage means.

Referring to the FIGS. 1 and 2, an ocean-going vessel is shown moving at a relatively slow pace, with a portion of a dredging pipeline having previously been run out and extending beneath and behind the vessel as further pipe is being run down. The length of pipe shown extending below the vessel in FIG. 2 is supported by primary pipeline holders supported from the inner gimbaled platform 33, and capable of total vertical movement by virtue of a hydraulic mechanism powered through the main hoist cylinders 11. In this system, pipe having the general configuration shown in copending application Ser. No. 910,424, referred to above, (including a main dredge line pipe and a secondary air line pipe, plus a pivotable splitter plate pivotally connected to the secondary air line pipe) is resting in the pipe rack 3. The crane member 102, is placed above the location of the individual pipe length and the spreader bar 4 is moved vertically downwardly until the crane grippers 5 can hold the ends of the pipe length. The pipe length is then raised together with the spreader bar 4 rising upwardly along the tracks on the truss 2, while the horizontal crane member 102 is moved laterally in a starboard direction, until the spreader bar 4 and the pipe length are located directly over the longitudinal tracks 10. The heel carriage is located at the end of the tracks 10, and the crane assembly and the pipe rack are so located that the end of the pipe, and specifically the enlarged hub end, fits into the pipe-securing means on the heel carriage, while the toe carriage is positioned so that the crotch of the pipe support holder 80 is located directly beneath the pipe portion located between the enlarged hub end and the beginning of the splitter plates and secondary air pipe. The pipe section is lowered until the pipe rests upon the toe and heel carriages. The heel carriages pipe support platform is arranged in the position shown in FIG. 16, such that the pipe support plate 70 is facing rearwardly along the tracks 10. The pipe hub is guided by the replaceable pipe guides 670 until the lowermost portion of the pipe hub rests upon the lower pipe support guide 370 and the side portions of the pipe hub are adjacent the side pipe support guide 270. The pipe locking arms 470 are manually moved until the heel pipe locking lugs 170 are in position around and over the pipe hub end, thus securing the forward end of the pipe to the heel support plate 70.

Figure 10:
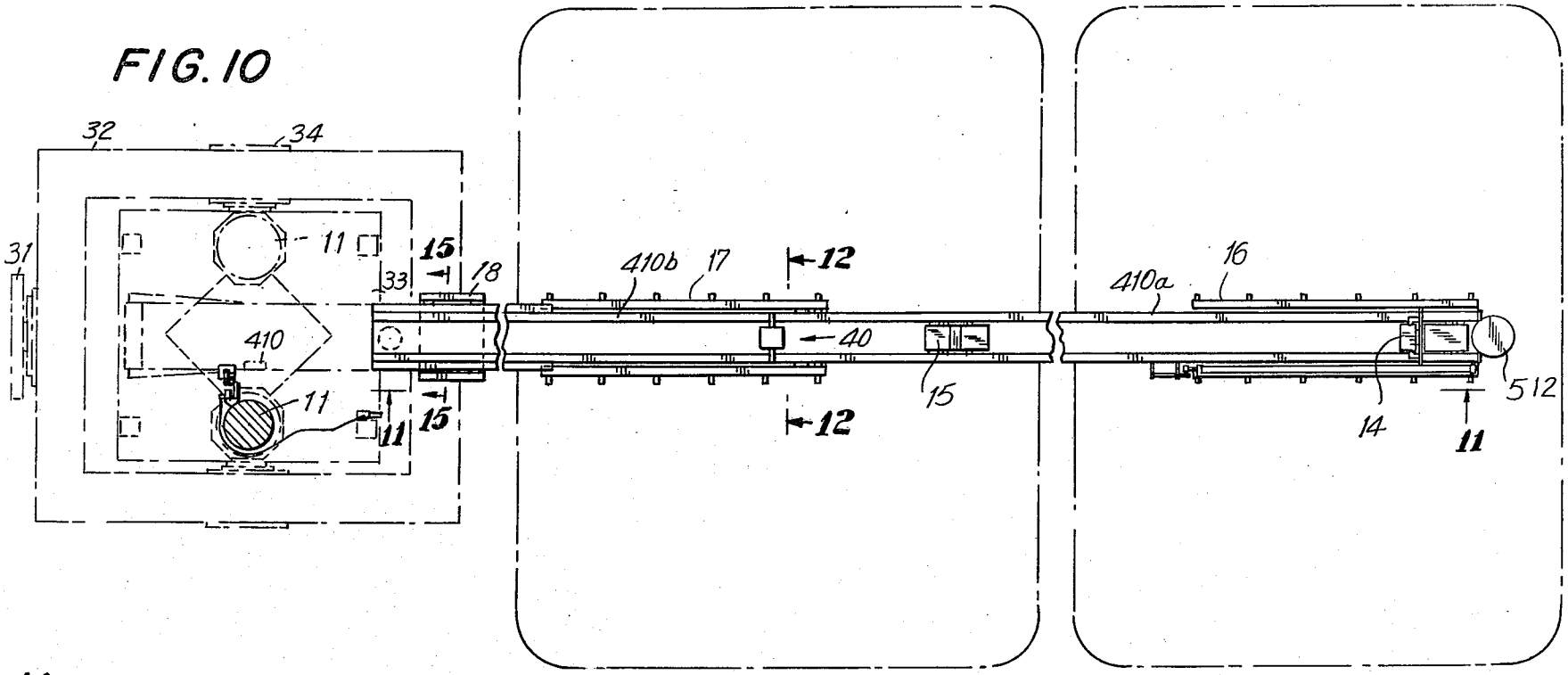
FIG. 10 is a partly broken plan view of the track members.
Figure 11:
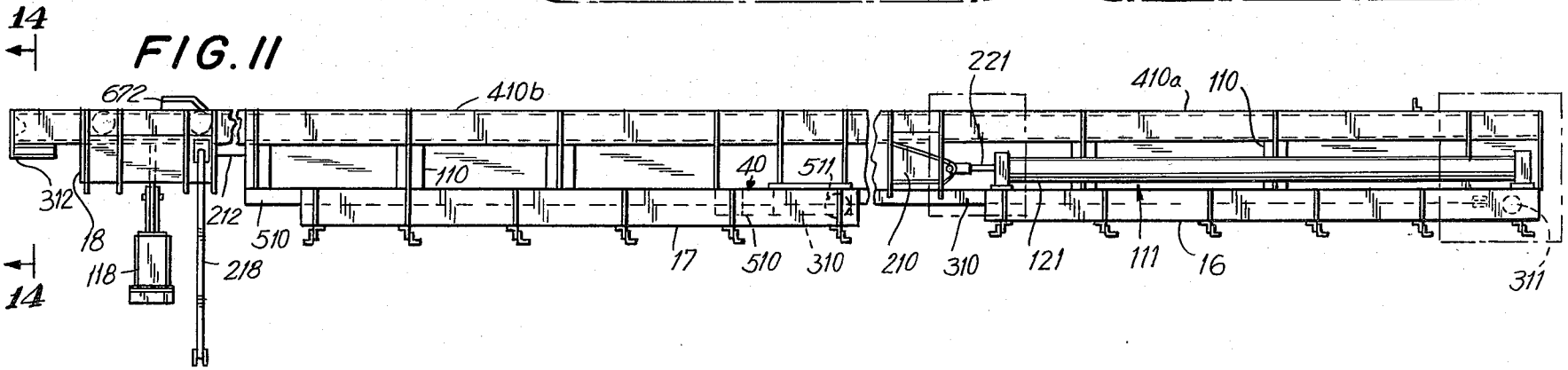
FIG. 11 is a side elevation view taken along lines 11—11 of FIG. 10.
Figure 13:
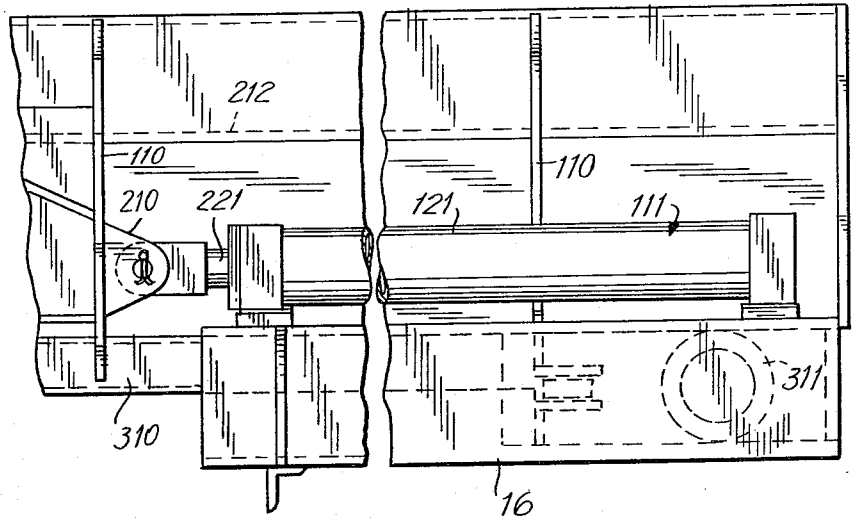
FIG. 13 is a partially broken enlarged view of the right hand portion of FIG. 11.

The track 10 is placed in its forwardmost position furthest from the derrick 8. After the pipe is secured to the heel carriage 14 and is resting securely upon the toe carriage 15, the track 10 is rolled rearwardly by energizing the hydraulic track drive 111 such that the track drive piston rod 221 pushes against the drive bracket 210, which in turn moves the drive posts 110, such that the track moves on rollers 311, 511 along the forward track support 16 and the central track support 17, until the rearwardmost track end, which moves on rollers 518 on the rearward track support 18, moves directly over and beyond the vertical central axis of the inner gimbaled platform 33, to the position shown by phantom lines in FIG. 10. The cable drum and motor 412, 512 move with the track 10.

The clutch handle 415 on the toe carriage 15 is moved rearwardly, pushing the cam pin 555 downwardly and thus permitting the cable clutch connector 515 to move towards the clutch support bracket 1015, clamping the cable 212 therebetween. The clutch cable is held in place by the force of the bias springs 715. The cable drive motor is then energized such that the cable drum 412 turns causing the cable to move and pull the toe carriage 14 and heel carriage 15 along the track 10.

Figure 5:
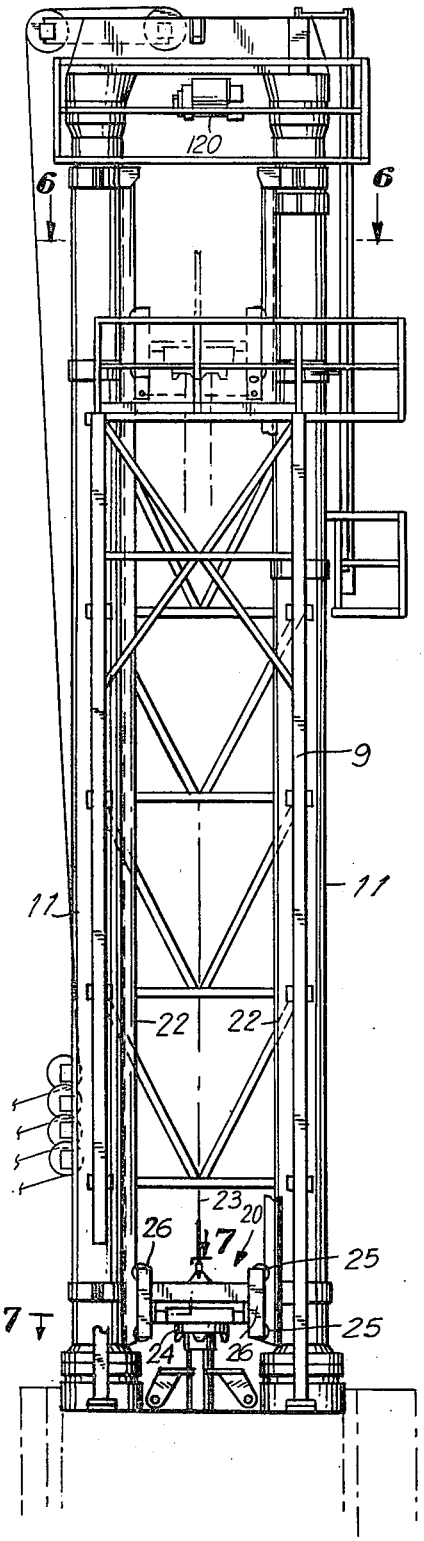
FIG. 5 is a front elevation view of the upper derrick portion of FIG. 3.
Figure 6:
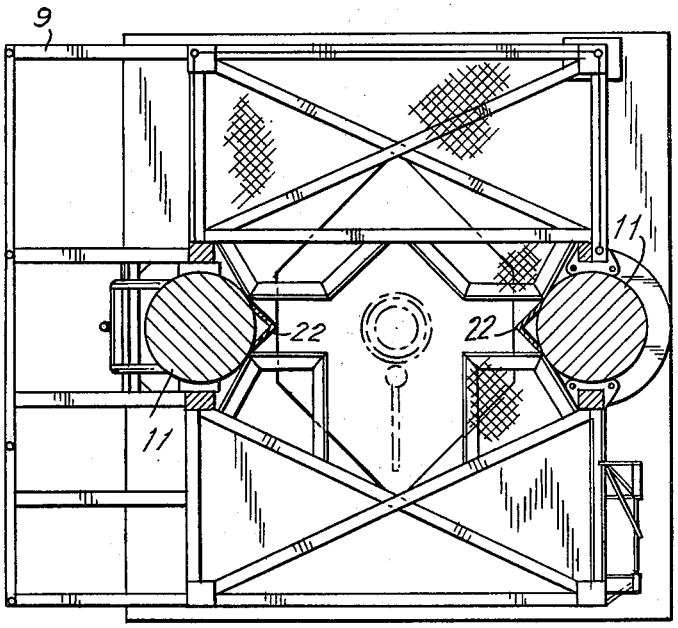
FIG. 6 is a cross-sectional view taken along lines 6—6 of FIG. 5.
Figure 7:
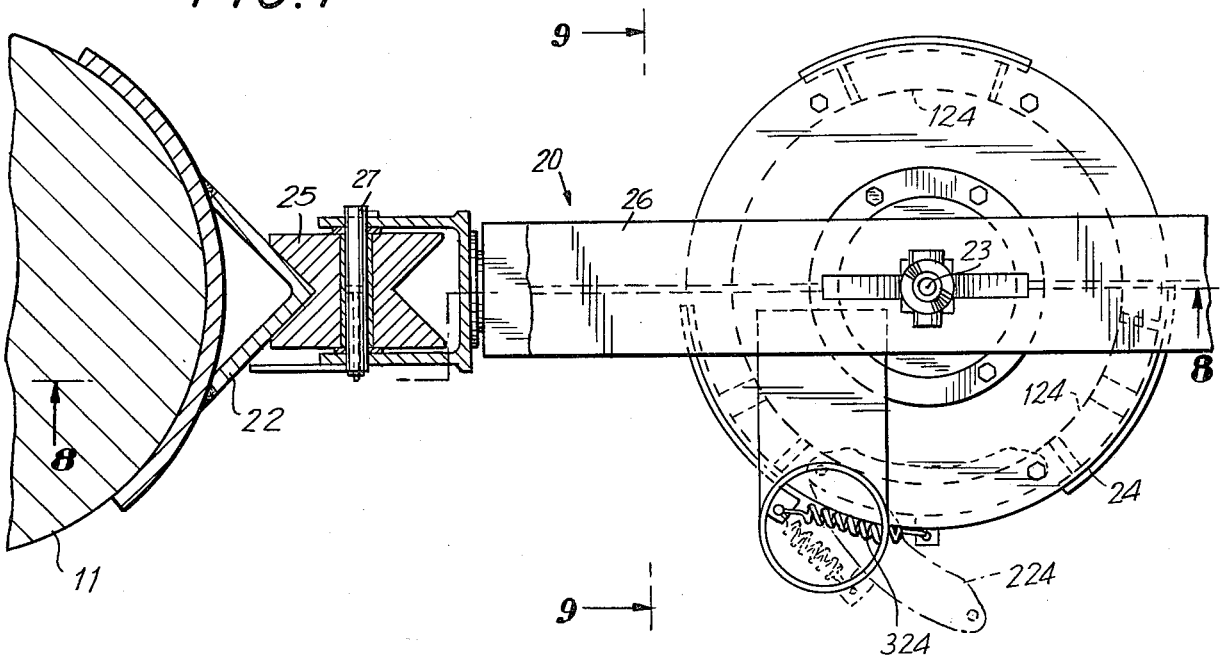
FIG. 7 is a partial section view taken along lines 7—7 of FIG. 5, showing a portion of the elevator means.
Figure 9:
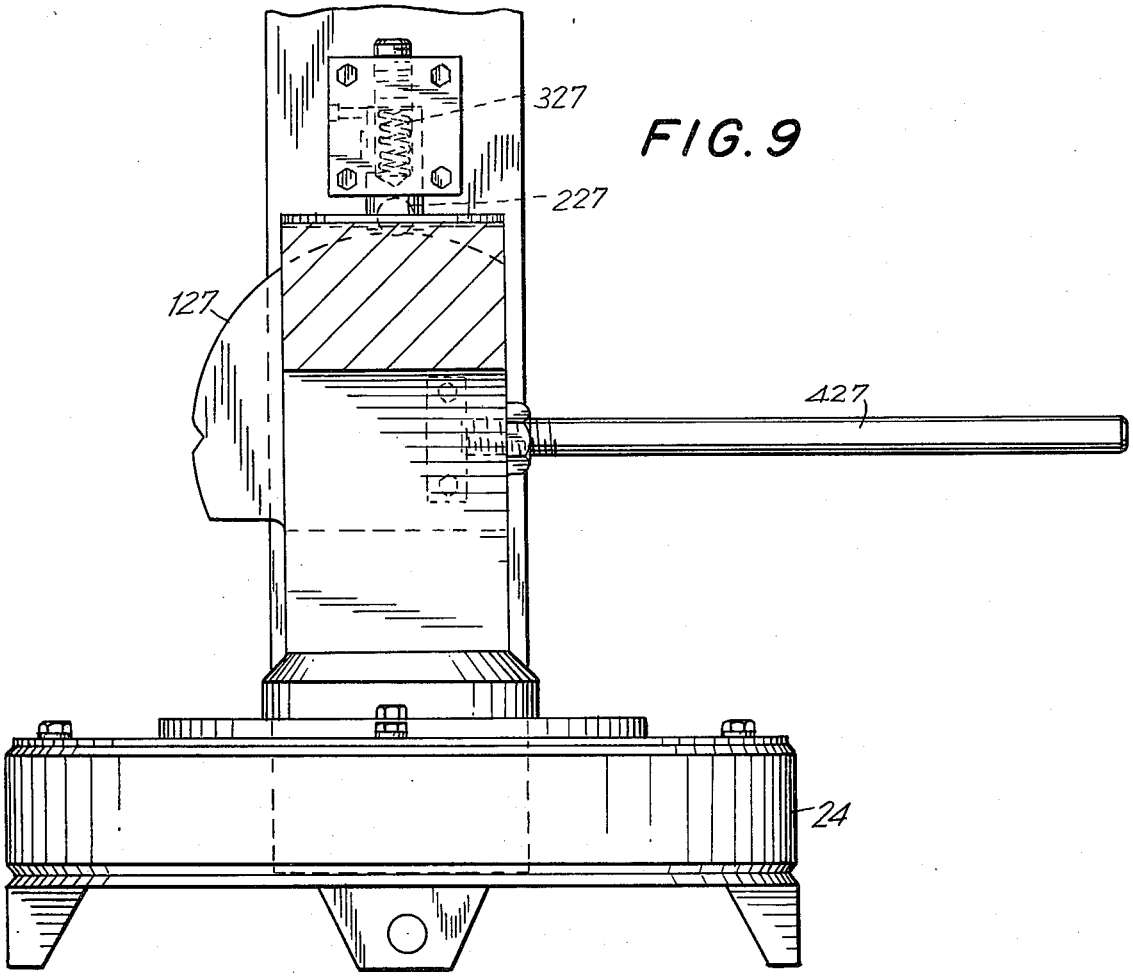
FIG. 9 is a section view taken along lines 9—9 of FIG. 7.
Figure 8:
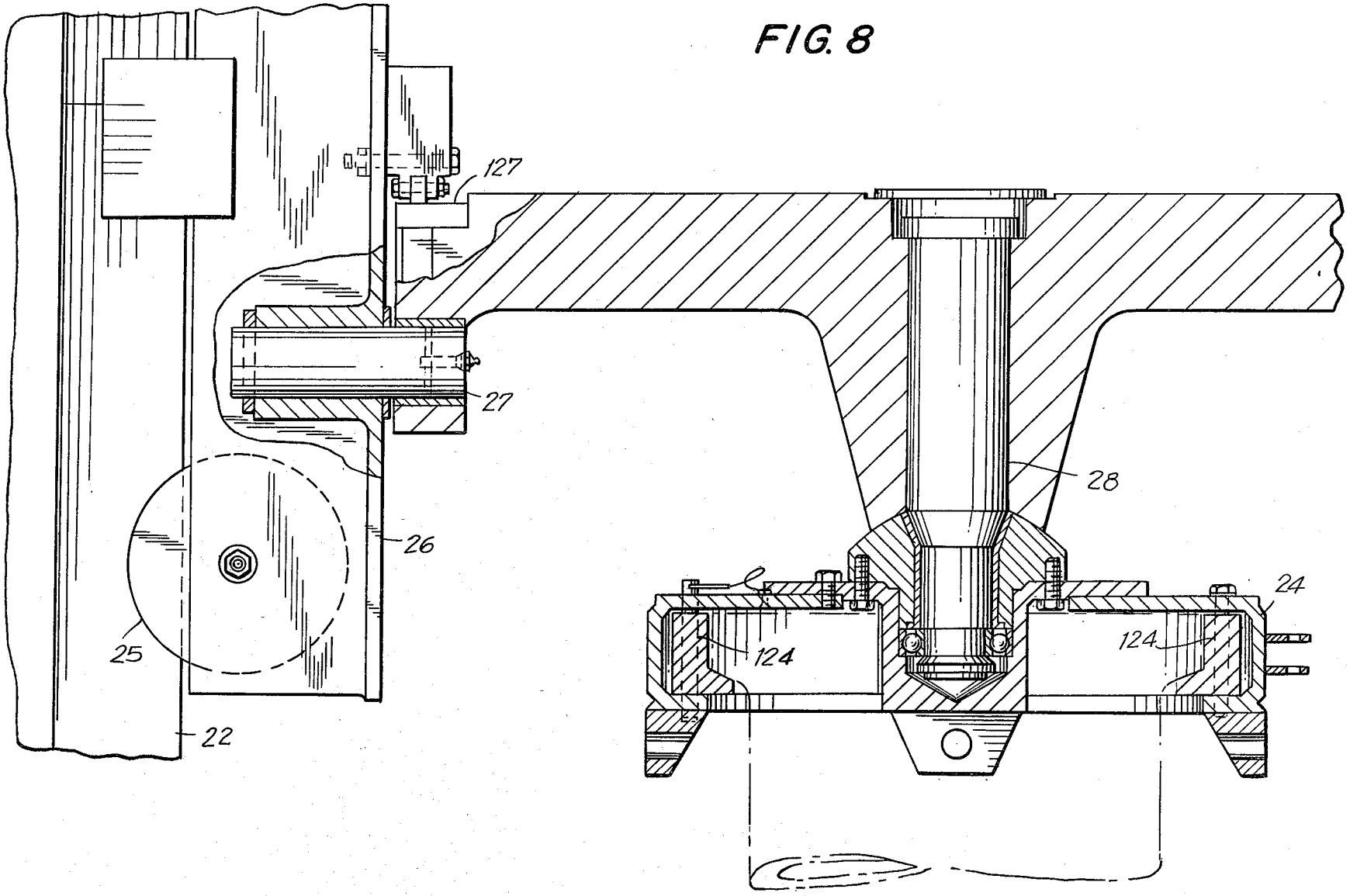
FIG. 8 is a partial, broken away, section view taken along lines 8—8 of FIG. 7.

In the meantime, the elevator 20 is placed in the lower position shown in FIG. 5, and the elevator pipe holder 24 is swung manually by pressing downwardly on the swing handle 427 until the pipe holder is facing horizontally towards the toe carriage moving along the track 10. The clamp handle 224 is moved outwardly so as to move the clamp lock members 124 into the unlocked position.

The elevator pipe holder 24 is locked into its horizontally facing position by the spring biased lock member 227 being pressed into the notch, or ratchet notch, formed in the surface of rotation of the pipe swing lock ratchet surface 127.

As the rearwardmost, i.e., toe end, of the pipe being carried on the carriages 14, 15, approaches the derrick 8, the carriage drive motor 512 is gradually slowed until immediately before the toe end pipe hub is to contact the elevator pipe holder, the drive is stopped and the toe carriage clutch handle is pivoted to the left so as to open the clutch connector 515, against the spring biasing action of clutch biasing spring 715, while simultaneously moving the brake pad 55 upwardly, but not sufficiently to contact the inner surface of the track channel 410.

The pipe hub is then secured into the elevator pipe holder 24 by centering the pipe hub in the pipe holder 24 and pivoting the clamp handle 224, against the biasing action of clamp spring 324, so as to rotate the pipe clamp members 124 into a position preventing the removal of the pipe hub from the pipe holder 24.

The elevator hoist motor 120 is then energized and the elevator 20 begins to move upwardly. At this time, the cable drive drum 612 is permitted to rotate freely and the pipe begins to swing upwardly, in the manner shown in FIG. 28. As the elevator 20 rises, pulling the toe end of the pipe upwardly, the heel end of the pipe, still secured in the heel carriage 15, moves towards the derrick 8, pulling the heel carriage with it.

Simultaneously, the pipe heel support plate 70 begins to pivot upwardly by the action of the pipe. The heel carriage 14 is pulled along the track, in a rearward direction, until the heel carriage is substantially directly beneath the elevator centerline, i.e., over the vertical centerline of the inner gimbaled support platform 33. At this point, the heel pipe locking lugs 170 can be manually rotated to release the pipe heel hub from the heel carriage, or alternatively, in the particular embodiment shown in these drawings, the locking lever 72 is automatically rotated by its rearward surface pressing against the stop members 672, rigidly connected to the rearward end of the track 10; the locking levers 72 in turn contact the pipe locking arms 470, and cause the rotation of the heel pipe locking lugs to the unlocked position.

When the locking lugs 170 are in the unlocked position, the heel carriage should be substantially directly beneath the elevator, such that the pipe length is in a substantially completely vertical position. Upon disconnecting the pipe heel hub from the heel carriage, the pipe heel hub, i.e., the lowest portion of the vertically extending pipe length, is preferably restrained to prevent any pendular movement. The track drive motor 111 is then actuated to move the tracks 10 forwardly, to the position shown in the solid lines in FIG. 10, so as to permit downward movement of the vertically supported pipe from the elevator to the top of the pipe string supported by the derrick 8.

To provide for contact of the horizontally moving pipe hub on the track 10 to the horizontally facing elevator pipe clamp holder 24, even in the event of relatively rough weather, i.e., high wave motion of the ocean, the track is supported at its forward end on the outer gimbal ring 32, by way of the forward support stand 18. That same forward support stand 18 which is pivotally connected to the gimbal ring by way of the pivotal joint 318, is also connected to the forward support lever arm 218 which is rigidly attached to the vessel's deck. Thus, in the event of rolling wave motion, wherein the vessel's deck surface pivotally reciprocates relative to the outer gimbal ring 34, the relative pivotal motion is communicated through the track support 18 by way of the pivoting motion about pin 318. This pivoting, however, is not as great as the relative pivoting motion between the outer gimbal ring and the deck surface of the vessel. Furthermore, to compensate for the movement of the inner gimbal platform 34 relative to the vessel's deck surface, and thus to the primary forward portion of the track 10*a*, the rearward segment of the track 10*b* is permitted to pivot about the hinged joint 40, both about an axis perpendicular to the longitudinal axis of the track 10 (but in the plane of the trace surface) and about a vertical axis, permitting sidewise motion of the tracks, in the event of pitching and rolling movement. Thus, the pipe can approach the elevator while the track can move to compensate for the relative rolling and pitching movement. The pipe moving along the track 10*b* as it approaches the elevator clamp holder, can be held relatively in line with the clamp holder so as to permit ready connection being made to the elevator clamp, even under relatively rough ocean conditions.

In a most preferred embodiment, as pointed out above when the individual pipe length is held in the completely vertical position from the elevator 20, the lower end of the pipe is preferably mechanically restrained. Such a restraining mechanism is shown in FIGS. 30 and 29. This mechanism can be swung in and out of position directly between the main hoist cylinders 11, permitting lateral support of a pipe vertically suspended from the elevator 20. This mechanical restraining means as shown, is a hydraulically actuated arm 217 which can retain the pipe between the digits 210 and 212. When the pipe is connected to the upper portion of the pipe string which is supported directly from the main hoist hydraulic mechanism, this mechanical restraining arm releases the pipe and once again swings out of the way, out from between the hoist cylinders 11.

The connection between the vertically suspended pipe from the elevator and the main pipe string is made by a pipe clamp, of design which does not form any part of this invention. After the supported pipe length is secured to the pipe string, the entire pipe string is let down that one full length by the main hoist hydraulic system. The system is then prepared to deliver a further length of pipe, repeating the procedures described above.

When bringing the pipe up from the ocean floor, the procedure described is reversed: the main hoist cylinders bring up the entire pipe string one length at a time, the upper end of the top connected pipe being secured to the elevator pipe holder 24, when the elevator is at the top of the derrick 8. The remainder of the pipe string is supported from the next lower pipe length by the main hoist cylinders. The joint between the upper length of pipe and the next lower length is removed and the track then moved into position between the pipe string, below, and the individual length of pipe above, the heel skate being connected to the lower hub of the suspended pipe length. The cycle described above is then repeated, in reverse.

The patentable embodiments of this invention which are claimed are as follows:

1. On a floating surface vessel designed for the dredging of the abyssal ocean depths, the vessel comprising main dredge line hoist means, for supporting a pipeline extending from the vessel to the ocean floor, the dredge line hoist means being pivotally connected to the vessel about at least two transverse axes; and storage means for storing individual pipe lengths on the surface vessel; the improvement comprising:

(a) track means for transporting individual pipe lengths from the storage means to the relatively pivotably movable dredge line hoist means;

(b) primary track support means, secured to the vessel and movably supporting the track means at least at one end thereof, the track means extending in line with one of the transverse axes about which the dredge line hoist means is pivotally connected to the floating surface vessel;

(c) secondary track support means pivotally connected to the vessel about a single axis parallel to the centerline of the track means and to one of the transverse axes about which the dredge line hoist means is pivotally connected to the surface vessel; the secondary track support means being adjacent the dredge line hoist means; and (d) pivot means, connecting the portion of the track means supported on the secondary support means to the remaining portion of the track means, the pivot means permitting relative pivotal motion between the first and second portions of the track means about at least a vertical axis.

2. On the floating surface vessel of claim 1, comprising in addition carriage means movably supported on the track means for carrying an individual pipe length between the pipe storage means and the dredge line support means, along the track means.

3. On the floating surface vessel of claim 2 comprising in addition means for longitudinally moving the track means such that the first end of the track means is moved between a position directly above the dredge line hoist means and a position longitudinally away from the dredge line hoist means, closer to the storage means.

4. The floating surface vessel of claim 2 wherein the carriage means for carrying an individual length of pipe along the track means comprises a first carriage means for holding a first end of the pipe length and a second carriage means for supporting and holding a second end of the individual pipe length, the two carriages being capable of moving longitudinally along the track means while supporting the individual pipe length in a substantially horizontal attitude.

5. The floating surface vessel of claim 4, wherein the second carriage means is further removed from the dredge line support means than the first carriage means, and comprises releasable pipe securing means for supporting and securing a pipe end to the second carriage means.

6. The floating surface vessel of claim 5, comprising in addition, pivotable connecting means between the pipe securing means and the second carriage means whereby the pipe supporting means and any pipe connected thereto can be pivoted from a horizontal attitude to a vertical attitude extending upwardly from the second carriage means.

7. The surface vessel of claim 5, comprising camming means secured to the track means for automatically releasing the connection between the second carriage means and the second end of the pipe.

8. The surface vessel of claim 2, comprising in addition, motor means for driving at least one carriage means along the track means.

9. The surface vessel of claim 8, wherein the motor means comprises a cable drive extending from the first end of the track means to the second end of the track means and permitting continuous movement of a cable along a line adjacent the track means.

10. The surface vessel of claim 9, comprising releasable clutch means between at least one of the carriage means and the cable of the motor means.

11. The surface vessel of claim 10, wherein a second carriage means is permanently secured to the cable, whereby actuating the cable by the motor means directly causes motion of that carriage means.

12. The surface vessel of claim 10 wherein the releasable clutch means serves to releasably secure the first carriage means to the carriage drive means.

13. On the floating surface vessel of claim 1 comprising in addition elevator means, vertically movably connected to the vessel along a line extending upwardly from the dredge line support means, the elevator means comprising pipe holder means for elevating a first end of the pipe to a position wherein an individual length of pipe is vertically suspended above the dredge line hoist means.

14. The floating surface vessel of claim 1 comprising in addition crane means for holding an individual length of pipe in a horizontal attitude, and designed to move an individual pipe length from the pipe storage means to a position from which the pipe can be transported by the track means.

15. The floating surface vessel of claim 1, comprising in addition, means for longitudinally and reciprocally moving the track means from a position wherein one end is located substantially at least directly beneath the elevator means, to a second position wherein the track means is moved out of position directly beneath the elevator means.

16. The floating surface vessel of claim 1 wherein the track means is supported sufficiently above the vessel surface, and has sufficient unobstructed depth beneath the track means, to permit the carrying of an individual length of pipe having hinged pendular plates extending therebeneath, between the ends of the pipe supported by the track means.

17. The surface vessel of claim 1, wherein the centerline of the track means and the centerline of the single axis about which the secondary track support means is pivotally connected to the surface vessel are parallel and both within the central longitudinal plane of the surface vessel.

18. On a floating surface vessel designed for the dredging of the abyssal ocean depths, the vessel comprising main dredge line hoist means, for supporting a pipeline extending from the vessel to the ocean floor, the dredge line hoist means being pivotally connected to the vessel about at least two transverse axes; and storage means for storing individual pipe lengths on the surface vessel; the improvement comprising:

(a) transversely segmented track means for transporting individual pipe lengths from a first end adjacent the storage means to a second end adjacent the relatively pivotably movable dredge line hoist means, a first track segment having an end adjacent the storage means and second track segment having an end adjacent the hoist means, each pipe end to be supported on a carriage moving on the track means;

(b) pivoting connecting means, connecting the second track segment to the first track segment, the pivot means permitting relative pivotal motion between the first and second track segments about an axis substantially perpendicular to the longitudinal axis of the track means and parallel to one axis about which the main hoist pivots relative to the vessel;

(c) track support means for longitudinally movably connecting the track means to the surface vessel; and (d) means for moving the track means between a first position wherein the second end extends substantially directly above the hoist means and a second position wherein substantially no portion of the track means is directly above the hoist means.

19. The floating surface vessel of claim 18 comprising secondary track support means movably supporting the second track segment and being pivotally connected to the vessel about a single axis parallel to the longitudinal axis of the track means and to one axis about which the dredge line hoist means pivots, and wherein the pivoting connecting means also permits relative pivoting motion between the track segments about a vertical axis.

20. The floating surface vessel of claim 19 wherein the pivoting means is adapted to permit in addition relative swiveling motion between the track segments about an axis parallel to the longitudinal axis of the track means and to one axis about which the dredge line hoist means pivots.

21. The floating surface vessel of claim 19 comprising in addition elevator means, vertically movably connected to the vessel along a line extending upwardly from the dredge line hoist means, the elevator means comprising pipe holder means for elevating a first end of the pipe to a position wherein an individual length of pipe is vertically suspended above the dredge line support means.

22. The floating surface vessel of claim 18, comprising in addition carriage means riding on the track means for moving the individual pipe lengths between the pipe storage means and the dredge line support means.

23. The floating surface vessel of claim 22 wherein the carriage means for carrying an individual length of pipe along the track means comprises a first carriage means for holding a first end of the pipe length and a second carriage means for supporting and holding a second end of the individual pipe length, the two carriages being capable of moving longitudinally along the track means while supporting the individual pipe length in a substantially horizontal attitude.

24. The floating surface vessel of claim 23, wherein the second carriage means is further removed from the dredge line hoist means than the first carriage means, and comprises releaseable pipe securing means for supporting and securing a pipe end to the second carriage means.

25. The surface vessel of claim 18, wherein the centerline of the track means and the centerline of the single axis about which the secondary track support means is pivotally connected to the surface vessel are parallel and both within the central longitudinal plane of the surface vessel.

26. On a floating surface vessel designed for the dredging of the abyssal ocean depths, the vessel comprising main dredge line hoist means, for supporting a pipeline extending from the vessel to the ocean floor, the dredge line hoist means being pivotally connected to the vessel about at least two transverse axes; and storage means for storing individual pipe lengths on the surface vessel; the improvement comprising:

(a) track means for transporting individual pipe lengths from a first end adjacent the storage means to a second end adjacent the relatively pivotably movable dredge line hoist means, at least the portion of the track means adjacent the hoist means being pivotable about the longitudinal axis of the track means, each pipe end to be supported on a carriage moving on the track means;

(b) track support means for longitudinally movably connecting the track means to the surface vessel; and (c) means for moving the track means between a first position wherein the second end extends substantially directly above the hoist means and a second position wherein substantially no portion of the track means is directly above the hoist means.

27. On the floating surface vessel of claim 26, wherein the entire track means is pivotable relative to the vessel about the longitudinal axis of the track means.

28. On a floating vessel designed for the dredging of the abyssal ocean depths, the vessel comprising main dredge line hoist means, for supporting a pipeline extending from the vessel to the ocean floor, the dredge line hoist means being pivotally connected to the vessel about at least two transverse axes; and storage means for storing individual pipe lengths on the surface vessel; the improvement comprising:

(a) track means for transporting individual pipe lengths from the storage means to the relatively pivotably movable dredge line hoist means;

(b) primary track support means, secured to the vessel and movably supporting the track means at least at one end thereof, the track means extending in line with one of the transverse axes about which the dredge line hoist means is pivotally connected to the floating surface vessel;

(c) secondary track support means pivotally connected to the vessel about a single axis parallel to the centerline of the track means and to one of the transverse axes about which the dredge line hoist means is pivotally connected to the surface vessel; the secondary track support means being adjacent the dredge line hoist means; and (d) pivot means, connecting the portion of the track means supported on the secondary support means to the remaining portion of the track means, the pivot means permitting relative pivotal motion between the first and second portions of the track means about at least two transverse axes.

* * * * *